United States Patent [19]

Guiler et al.

[11] 4,424,995

[45] Jan. 10, 1984

[54] BALL TYPE SEAL

[75] Inventors: Richard S. Guiler, Newton; Jacob E. Mautner, Keyport, both of N.J.; Sigurd M. Moberg, Etlan, Va.

[73] Assignee: E. J. Brooks Company, Newark, N.J.

[21] Appl. No.: 203,565

[22] Filed: Nov. 5, 1980

[51] Int. Cl.[3] ..... B65D 27/30; B65D 33/34; B65D 55/06

[52] U.S. Cl. ..... 292/323

[58] Field of Search ..... 292/307 R, 307 B, 318, 292/319, 323, 324; 70/50, 440

[56] References Cited

U.S. PATENT DOCUMENTS

| | | | |
|---|---|---|---|
| 800,545 | 9/1905 | Brooks | 292/323 |
| 1,026,701 | 5/1912 | Reid | 292/318 |
| 1,065,934 | 7/1913 | Fox | 292/323 |
| 1,169,217 | 1/1916 | Wilcox | 292/323 |
| 1,173,603 | 2/1916 | Murray et al. | 292/318 |
| 1,866,461 | 5/1932 | Goschnick | 292/319 |

FOREIGN PATENT DOCUMENTS

| | | | |
|---|---|---|---|
| 461807 | 3/1929 | Fed. Rep. of Germany | 292/318 |
| 588857 | 2/1925 | France | 292/318 |
| 654709 | 12/1928 | France | 292/323 |

*Primary Examiner*—Thomas J. Holko
*Attorney, Agent, or Firm*—Robert E. Ross

[57] ABSTRACT

A security seal of the type having a housing with an opening to receive a flat strap type of shackle, in which the shackle has an aperture near the end, and said housing has internal means for engaging the shackle to prevent removal after the shackle is properly inserted. The internal means comprises deformable legs which are so deformed by the insertion of the strap end that a free end of one locking leg is caused to move through the aperture of the inserted strap to lock it against removal. In one embodiment of the invention the locking leg has hook means on the free end engaging a stationary portion of the internal structure after it has passed through the strap opening. In another embodiment of the invention two sets of deformable legs are provided so that both ends of a shackle may be engaged in the housing, thereby allowing the user of the seal to provide his own shackles with his own numbering system.

10 Claims, 9 Drawing Figures

BALL TYPE SEAL

BACKGROUND OF THE INVENTION

A type of security seal commonly known as a "ball seal" is widely used to seal the doors of railroad freight cars, trucks and other containers. Such seals comprise a metal housing with a metal strap shackle having one end secured to the housing. The other end of the shackle is insertable into a housing aperture into locking engagement with suitable internal means.

Although such seals are widely used, improvements in reliability and tamper resistance are always desirable. Also, it has been found that some seal users would prefer to provide their own shackles, and apply their own identification numbers, for greater security, which is not possible at present since one end of the shackle is permanently attached to the seal body. Numbering of such seals is generally a time consuming hand operation.

SUMMARY OF THE INVENTION

This invention provides a security seal of the type having a housing with an aperture and internal structure for receiving the end of a flat shackle having an aperture near the end.

The internal structure comprises a base forming a slot for receiving the shackle end, a deformable leg having an upwardly extending medial portion and a free end extending into the path of the entering shackle end, so that on insertion of the shackle, the end thereof engages a suitable detent on the free end of the leg, and moves said free end rearwardly to cause the leg to straighten so as to move the upwardly extending portion downwardly. A locking leg extends downwardly from the medial portion of said deformable leg. The lower end of the locking leg is originally positioned above the plane of the entering shackle, and is moved downwardly with the downward movement of the medial portion so that it passes through the hole in the forward end of the shackle and through an aperture in the base to protrude below the base. The end of the locking leg is provided with suitable hook means for catching on the edge of the base aperture to prevent reverse movement of the shackle. The forward end of the deformable leg is also provided with a suitable tang or hook for engaging in an aperture in the base when the leg has deformed the desired amount.

In one embodiment of the invention one end of the shackle is permanently attached to the internal structure in the housing, the other end being insertable into locking engagement in the housing. In another embodiment of the invention, two apertures and two sets of internal shackle engaging structures are provided in the housing, so that both ends of a separate shackle may be engaged with the housing.

DESCRIPTION OF THE ILLUSTRATED EMBODIMENT

Figure 1:
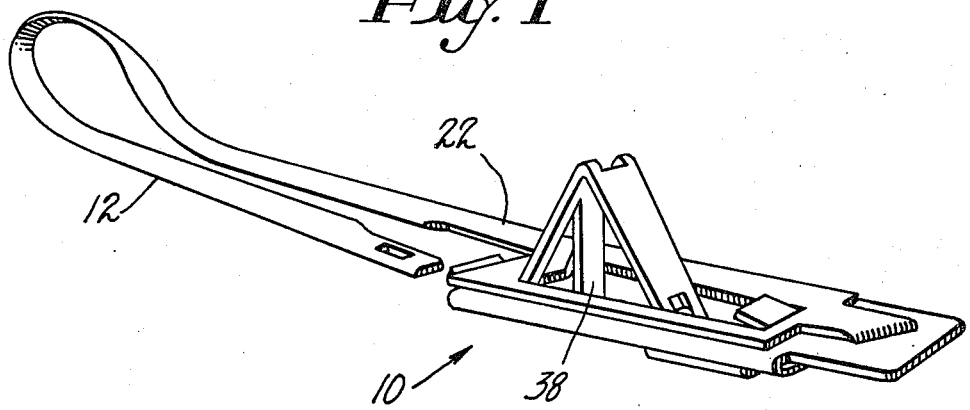
FIG. 1 is a perspective view of a seal embodying the features of the invention, with the housing partly broken away to show the internal structure.
Figure 2:
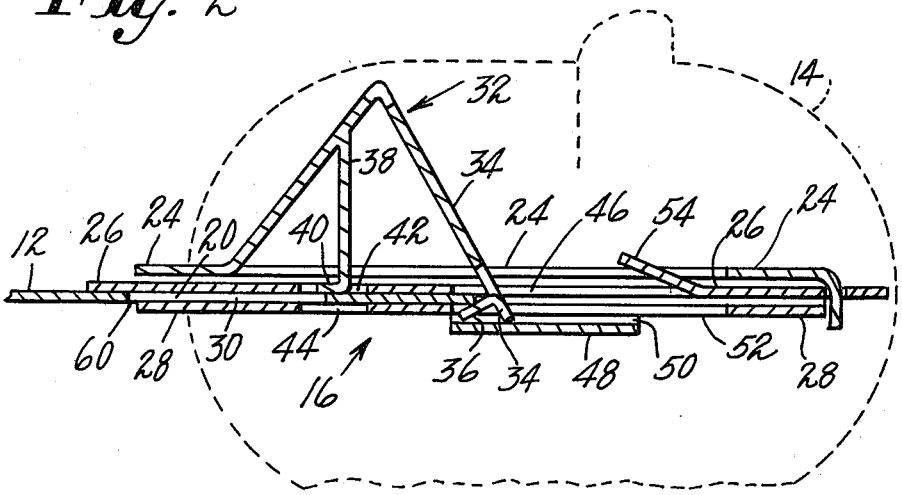
FIG. 2 is a view in side elevation of the internal structure of the seal body of FIG. 1.
Figure 3:
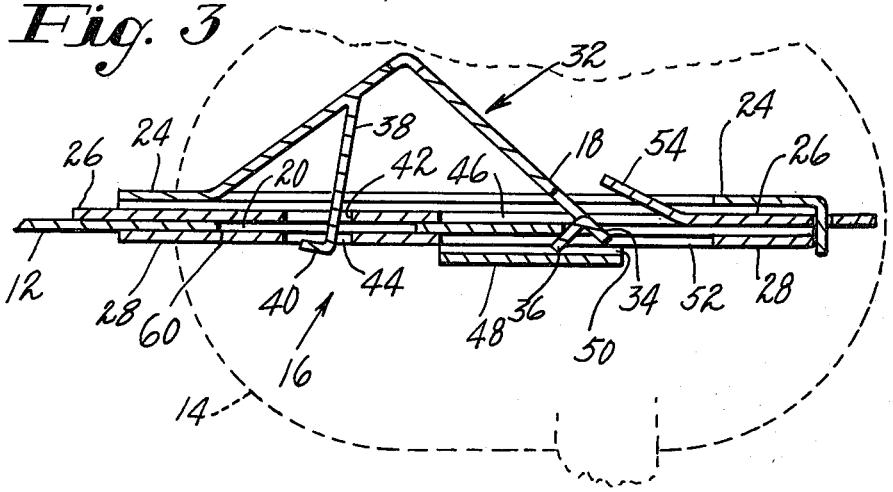
FIG. 3 is a view similar to FIG. 2 illustrating the deformation of the internal structure as the shackle enters the seal body.
Figure 4:
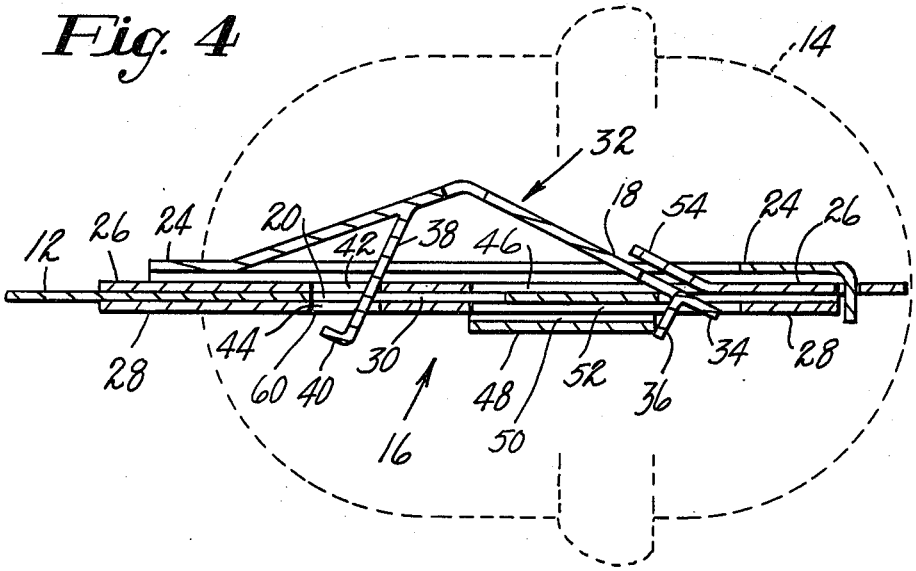
FIG. 4 is a view similar to FIG. 3 in which the shackle has completely entered the seal body, illustrating the action of the internal structure in locking the shackle in the housing.
Figure 5:
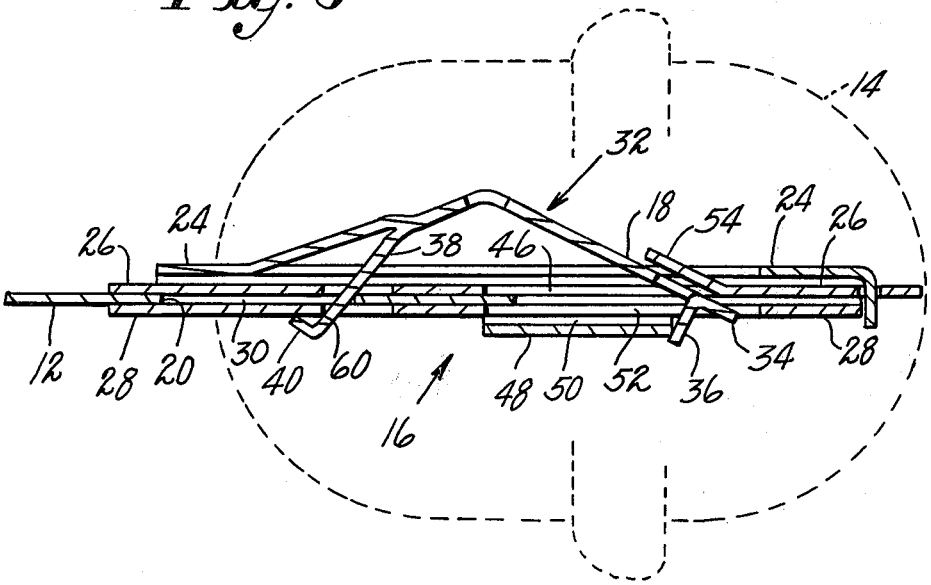
FIG. 5 is a view similar to FIG. 4, in which the shackle has been pulled outwardly, illustrating the locking action of the locking leg.

Referring to FIGS. 1–5 of the drawing, there is illustrated a security seal comprising a seal body 10 and a shackle 12. The body 10 comprises a hollow housing 14 and an internal structure 16 for receiving and retaining an end portion 18 of the shackle, said end portion having an aperture 20 therein for a purpose to appear hereinafter.

In the embodiment of FIGS. 1–4 one end 22 of the shackle 12 is fastened to or integral with the internal structure, and the other end is initially free for insertion through a closure mechanism (not shown) such as the staple of a door latch, and for insertion into the housing into locking engagement with the internal structure as will now be described.

In the preferred embodiment the internal structure 16 is made of a single piece of steel metal and comprises an elongated platform made up of upper, middle, and lower plates 24, 26, and 28. The upper plate overlies the middle plate, and the middle and lower plates are spaced apart vertically to form a passage 30 to receive the end portion 18 of the shackle as will appear hereinafter.

The upper member 24 is provided with a deformable leg 32 which is formed out of the material of the upper plate. The leg 32 is attached to the upper plate 24 at the forward end, from which it is inclined upwardly to an apex and then is inclined downwardly to a free end 34 which has a tang 36 formed thereon for a purpose to appear hereinafter. Depending from a position on the leg 32 near the apex is a locking leg 38 which has a lower free end formed with a hook-like member 40. Directly below the end of the locking leg 38 apertures 42 and 44 are provided in the medial plate 26 and lower plate 28 respectively, for a purpose to appear hereinafter.

The medial 26 is also provided with an aperture 46, and the lower plate 28 is provided with a depressed portion 48 forming a recess 50. An aperture 52 is provided at the rear end of the depressed portion, which cooperates with an upwardly inclined portion 54 at the rear end of aperture 42 in the middle plate 26 to cause the end 34 of the leg 32 to lock over the edge of the depressed portion 46 as will now be described.

As the shackle end 18 is inserted into the passage 30, the shackle end engages the free end 34 of leg 32 behind the tang 32 and causes the free end to move rearwardly (to the right in FIGS. 1–5). This rearward motion causes the leg 32 to tend to straighten, whereby the apex of the leg and the locking leg 38 move downwardly. As the motion of the shackle end continues, the end of the locking leg 38 moves downwardly through apertures 42 and 44 in the middle and lower plates and through the aperture 20 of the shackle so that the hook 40 on the end of the locking leg is disposed below the lower plate. (See FIG. 3). Thereafter the end 34 of the deformable leg 32 enters the space between the inclined tab 54 and the rear edge 58 of the depressed portion 48. Said space may be slightly narrower (in a direction perpendicular to the plane of the tab 54) than the length of the tang plus the thickness of the metal of which the leg 32 is formed, so that as the free end 34 passes under the tab 54, the tab flexes upwardly so that the tang 36 snaps behind the rear edge 58.

At this time the end of the leg 38 extends a desired distance below the bottom plate 28. Therefore if th shackle is pulled outwardly, the edge of the aperture 20 of the shackle engages the locking leg 38 and pulls it against the forward edge 60 of the aperture 28 in the lower plate 28, so that the hook 40 catches under said plate, preventing further outward movement of the shackle.

Figure 6:
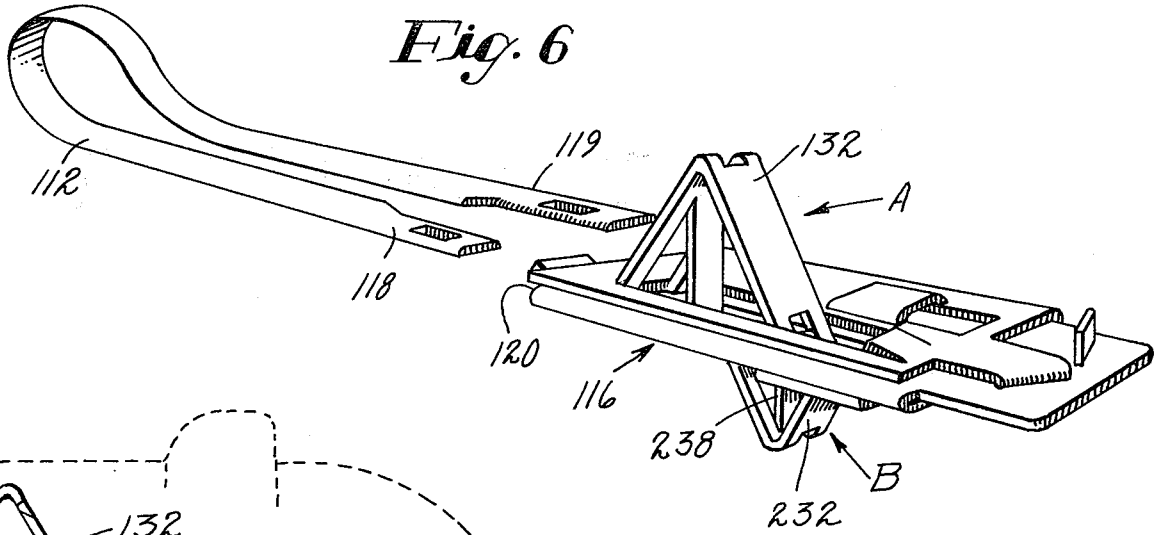
FIG. 6 is a perspective view of a modified form of seal body in which the housing contains two sets of shackle engaging structures.
Figure 7:
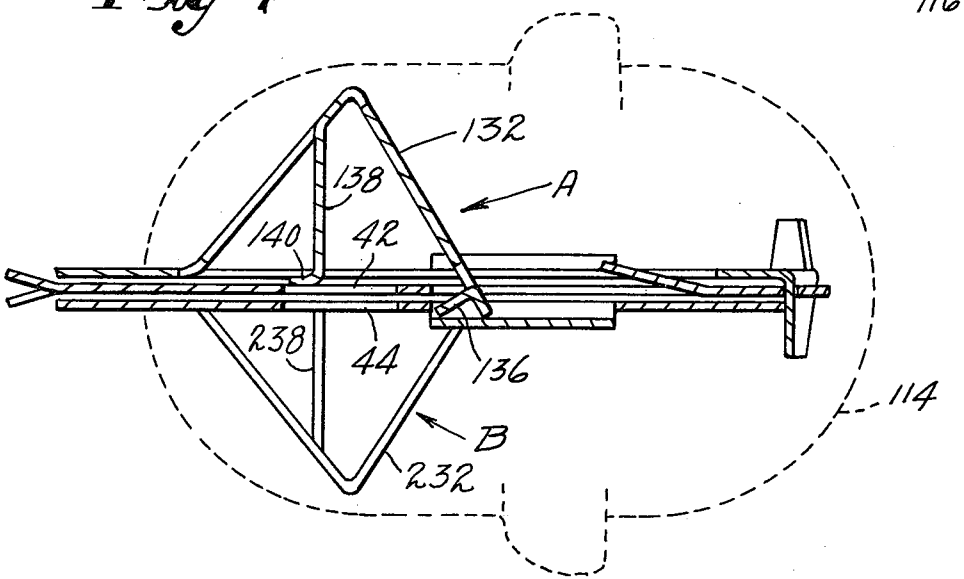
FIG. 7 is a view in side elevation, partly in section, of the seal body of FIG. 6.
Figure 8:
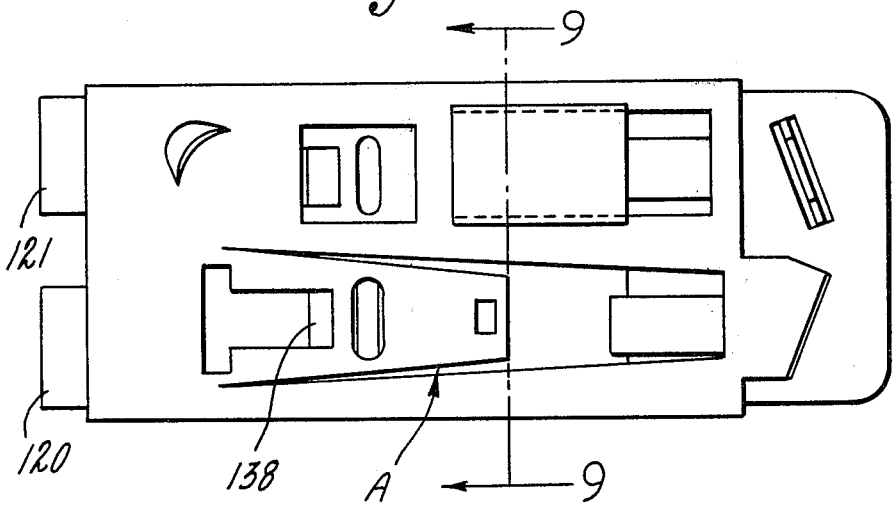
FIG. 8 is a top plan view of the internal structure of the seal of FIG. 7.
Figure 9:
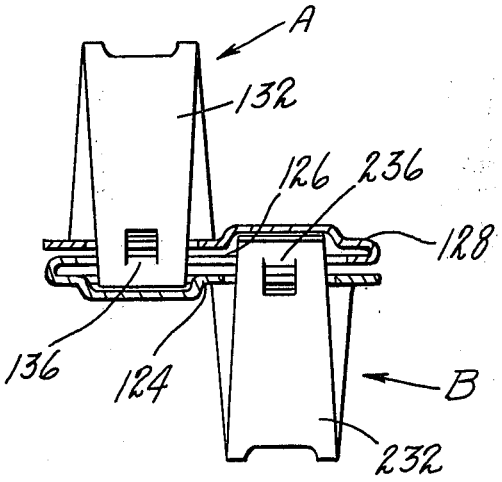
FIG. 9 is a view in section taken on line 9—9 of FIG. 8.

In the embodiment of FIGS. 1–5 the shackle is permanently attached to or is an integral part of the internal structure 16. However in applications in which the ultimate user of the seal wishes to provide his own identifying numbers or other indicia on the shackle, and wishes to manufacture his own shackles, the embodiment of FIGS. 6–10 may be used.

In the embodiment of FIGS. 6–10, a seal comprises a body 110 and a shackle 112. The body comprises a hollow housing 114 and an internal structure 116 which is adapted to receive and engage both ends 118 and 119 of the shackle, each of said shackle ends having an aperture (120, 121) positioned as in the previous embodiment. Also, as in the previous embodiment, the internal structure may be made of a platform formed of a single piece of sheet metal comprising upper, middle, and lower members 124, 126, and 128 which are formed into first and second shackle engaging portions A and B so that both ends of the shackle may be non-removably engaged with the seal.

The shackle engaging portion A is similat to the internal structure 16 of the embodiment of FIGS. 1–5, comprising a deformable leg 132 with a locking tang 136 and a locking leg 138 having a locking hook 40 which cooperate with the apertures 124, 126 and 128 of the upper, middle, and lower plates in the manner previously described when a shackle end such as 118 is inserted therein.

The shackle engaging portion B is spaced laterally on the internal structure from the shackle engaging portion A, and may be identical in structure to the shackle engaging portion A, except that in the illustrated embodiment, the shackle engaging portion A extends upwardly from the plane of the platform, whereas the shackle engaging portion B extends downwardly from the plane of the platform, and comprises a deformable leg 232 having a locking tang 236, and a locking leg 238 having a locking hook 240, which operate in the manner previously described.

Although in the embodiment of FIGS. 6–10 both shackle ends are received in the same end of the housing 114, in some cases it may be desirable that the ends of the shackle be received into opposite ends of the housing, in which case the position of the components of one shackle engaging portion may be reversed in relation to the components of the other.

The provision of two shackle engaging portions allows the shackle to manufactured by the seal user, so that they can apply their own numbers or other indicia, thereby providing greater security.

Since certain other changes apparent to one skilled in the art may be made in the illustrated embodiments of the invention, it is intended that all matter contained herein be interpreted in an illustrative and not a limiting sense.

I claim:

1. A body for a seal of the ball type comprising a housing having an aperture and means in the housing for receiving a relatively rigid shackle end in locking non-removable engagement, said means comprising a deformable leg having a portion initially positioned in the path of the inserted shackle end, said leg being positioned and dimensioned so as to be deformed by the insertion of the shackle end, and a locking leg having a free end, said locking leg being so associated with the deformable leg that the deformation of said deformable leg caused by the insertion of said shackle end causes the end of the locking leg to pass through the shackle aperture to thereby prevent movement of the shackle out of the housing.

2. A seal body of the ball type, comprising a housing containing means for receiving an apertured relatively rigid shackle in non-removable engagement, said means comprising a support forming an elongated channel to receive the end of the shackle and prevent lateral buckling thereof, said support carrying a leg having a free end projecting across said channel, said free end being positioned and dimensioned so as to be deformed by the insertion of said shackle into the channel, and a locking leg having a free end, said locking leg being so associated with said channel that deformation of said deformable leg by the insertion of the shackle into the channel causes the free end of the locking leg to move transversely through the channel and through the aperture in the shackle to lock the shackle in the housing.

3. A seal of the ball type comprising a housing and means in the housing receiving an apertured shackle in locking engagement, said means comprising a support having a pair of spaced elongated plates forming a channel therebetween for receiving the end of the shackle and an upper plate disposed over the spaced plates, a deformable leg formed from the upper plate, said leg having an upwardly extending medial portion and a free end extending through apertures in the spaced plates so that the free end is in the path of a shackle inserted into the channel between the spaced plates whereby insertion of the shackle tends to straighten the deformable leg so that the medial portion thereof moves toward the plane of the channel, and a locking leg carried by the medial portion of the deformable leg, said locking leg having a free end originally disposed above the plane of the channel which is movable downwardly by the deformation of the deformable leg to pass through the channel and the shackle aperture.

4. A seal body as set out in claim 3 in which said elongated plates and the free end of the deformable leg have cooperating means whereby when the free end of the deformable leg has moved the required distance by the insertion of the shackle, said cooperating means engage to maintain the deformable leg in the deformed position.

5. A seal body as set out in claim 3 in which said locking leg has hook means on the end positioned after passing through the shackle and plate apertures to engage the edge of a plate aperture to prevent removal of the shackle from the housing.

6. A seal of the ball type, comprising a housing having an aperture and means in the housing for receiving an apertured shackle end in locking non-removable engagement, said means being formed of a single piece of sheet material and comprising a support formed of upper, middle, and lower plates, the middle and lower plates being spaced apart to form a channel therebetween for receiving the apertured shackle end, a locking leg formed from the material of the upper plate and being positioned above aligned apertures in the middle and lower plates, and means responsive to the insertion of the shackle end into the channel to cause said locking leg to move downwardly through the aligned apertures and the shackle aperture.

7. A seal body as set out in claim 6 in which a deformable leg is formed from the material of said upper plate, said deformable leg having an upwardly extending medial portion and a free end extending into the channel between the middle and lower plates, whereby insertion of the shackle causes the deformable leg to straighten and the medial portion to move toward the plane of the channel, the locking leg being so associated with the deformable leg that said movement of the medial portion of the deformable leg causes the end of the locking leg to move through the aligned apertures of the middle and lower plates and the aperture of the inserted shackle end.

8. A seal body as set out in claim 7 in which said locking leg is formed from the material of the deformable leg and is attached to the upwardly extending medial portion.

9. A seal body, comprising a housing and means in the housing for receiving and engaging both ends of a shackle having relatively rigid ends and an aperture near each extreme end thereof, said means comprising a support forming a pair of spaced channels to receive the shackle ends, a pair of deformable members carried by the support, each member having a portion extending across a channel in the path of a shackle inserted therein, said members and said portions being so dimensioned that insertion of the shackle ends causes deformation of said members, and locking means associated with each of said members, each locking means being responsive to said deformation of the associated member by the shackle end to move transversely through the channel in which the shackle end is disposed and through the aperture of the shackle end disposed therein.

10. A seal body as set out in claim 9 in which the support is formed of a single piece of sheet metal comprising three superimposed plates, a channel being disposed between the medial plate and each outer plate, a deformable means being formed from the material of each outer plate, and a locking leg being formed from the material of each deformable means and being attached to the medial portion of said deformable means.

* * * * *